US009169983B2

(12) United States Patent
Miletich et al.

(10) Patent No.: US 9,169,983 B2
(45) Date of Patent: Oct. 27, 2015

(54) OVERHEAD LIGHT FIXTURE AND RELATED METHOD

(75) Inventors: Don Miletich, Franklin, WI (US); John Stanley, Racine, WI (US)

(73) Assignee: Cree, Inc., Durham, NC (US)

( * ) Notice: Subject to any disclaimer, the term of this patent is extended or adjusted under 35 U.S.C. 154(b) by 295 days.

(21) Appl. No.: 13/444,588

(22) Filed: Apr. 11, 2012

(65) Prior Publication Data

US 2013/0272003 A1 Oct. 17, 2013

(51) Int. Cl.

| | |
|---|---|
| ***F21S 8/00*** | (2006.01) |
| ***F21L 4/00*** | (2006.01) |
| ***F21S 8/02*** | (2006.01) |
| *F21S 8/04* | (2006.01) |

(52) U.S. Cl.

CPC ... *F21S 8/026* (2013.01); *F21S 8/04* (2013.01)

(58) Field of Classification Search

CPC ..... F21S 8/026; F21S 8/033; F21S 8/043; F21V 21/36; F21V 21/40; F21V 21/406; F21V 23/06

USPC ..... 362/147–150, 190–191, 194, 362–375, 362/404, 640, 652, 655–657, 217.1–217.17, 362/221

See application file for complete search history.

(56) References Cited

U.S. PATENT DOCUMENTS

| | | | | |
|---|---|---|---|---|
| 4,674,015 | A * | 6/1987 | Smith | 362/221 |
| 5,662,407 | A | 9/1997 | Fischer et al. | |
| 5,927,843 | A | 7/1999 | Haugaard et al. | |
| 5,941,632 | A * | 8/1999 | Wedell et al. | 362/410 |
| 5,997,158 | A | 12/1999 | Fischer et al. | |
| 6,116,749 | A | 9/2000 | Quiogue et al. | |
| 6,561,670 | B1 | 5/2003 | Jongewaard et al. | |
| 7,066,617 | B2 * | 6/2006 | Mandy et al. | 362/147 |
| 7,572,038 | B2 | 8/2009 | Kinnune et al. | |
| 7,922,351 | B2 * | 4/2011 | Welker | 362/217.11 |
| 8,414,144 | B2 * | 4/2013 | Yochum et al. | 362/221 |
| 8,814,398 | B2 * | 8/2014 | Kang et al. | 362/373 |
| 2001/0006463 | A1 * | 7/2001 | Fischer et al. | 362/374 |
| 2004/0076001 | A1 * | 4/2004 | Lutes | 362/221 |
| 2004/0184264 | A1 * | 9/2004 | Elam et al. | 362/148 |
| 2005/0200495 | A1 * | 9/2005 | Sibalich et al. | 340/693.11 |
| 2006/0262544 | A1 | 11/2006 | Piepgras et al. | |
| 2008/0080196 | A1 * | 4/2008 | Ruud et al. | 362/373 |
| 2008/0084698 | A1 * | 4/2008 | Kinnune et al. | 362/365 |
| 2008/0094838 | A1 * | 4/2008 | Russello et al. | 362/250 |
| 2008/0170398 | A1 * | 7/2008 | Kim | 362/260 |
| 2009/0097262 | A1 * | 4/2009 | Zhang et al. | 362/364 |
| 2009/0251898 | A1 | 10/2009 | Kinnune et al. | |
| 2010/0014289 | A1 * | 1/2010 | Thomas et al. | 362/235 |
| 2010/0128472 | A1 * | 5/2010 | Hancock et al. | 362/231 |
| 2010/0188845 | A1 * | 7/2010 | Rooms et al. | 362/191 |
| 2011/0317420 | A1 * | 12/2011 | Jeon et al. | 362/249.02 |

(Continued)

*Primary Examiner* — Jong-Suk (James) Lee
*Assistant Examiner* — Zheng Song
(74) *Attorney, Agent, or Firm* — Jansson Munger McKinley & Shape Ltd.

(57) ABSTRACT

An overhead LED light fixture including a base member with a vertical sleeve secured to the top of the base member for alignment with a pass-through opening. The fixture has a driver-tray assembly with a bottom member engageable with the base member at the pass-through opening, a vertical driver-support structure extending upwardly therefrom, at least one driver secured to the support structure, and the driver-tray assembly is slideably received within the vertical sleeve. When used as a canopy light, the driver-tray assembly is removable from below the canopy to facilitate servicing, upgrading or replacing of components.

17 Claims, 10 Drawing Sheets

(56) References Cited

U.S. PATENT DOCUMENTS

2012/0087118 A1 4/2012 Bailey et al.
2012/0092860 A1* 4/2012 Blackstone ..... 362/221
2013/0114259 A1* 5/2013 Kurkofka et al. ..... 362/249.01
2014/0160741 A1* 6/2014 Blackstone et al. ..... 362/221

* cited by examiner

OVERHEAD LIGHT FIXTURE AND RELATED METHOD

FIELD OF THE INVENTION

This invention is related generally to overhead light fixtures and, more particularly, to canopy-mounted light fixtures and to methods for servicing same.

BACKGROUND OF THE INVENTION

In describing the overhead light fixture of this invention and its advantages, particular reference will be made to what is referred to as canopy light fixtures; however, the inventive apparatus and method are more generally applicable to overhead lighting fixtures and in some cases to light fixtures in other mounting locations, orientations and positions.

Canopy-mounted light fixtures ("fixtures") are often used to provide lighting in areas such as service stations, drive-through facilities such as banks, and other outdoor lighting environments which are generally lighted from above, often high overhead. A great variety of canopy-mounted light fixtures have been developed. Some examples of such prior art fixtures are those disclosed in the following United States patents: U.S. Pat. No. 7,572,038 (Kinnune, et al.), U.S. Pat. No. 6,561,670 (Jongewaard, et al.), U.S. Pat. No. 6,116,749 (Quiogue, et al.), U.S. Pat. No. 5,997,158 (Fischer, et al.), U.S. Pat. No. 5,927,843 (Haugaard, et al.) and U.S. Pat. No. 5,662,407 (Fischer, et al.).

Some of the canopy-mounted light fixtures of the prior art, when in their use positions, are above, rather than below the generally horizontal planar structure which forms the sealing of the canopy. Such planar structure will be referred to herein as the "canopy sheet." Such member is most typically sheet metal, but may be of other materials. Above-sheet positioning of light fixtures is often deemed preferential from a design point of view. In other words, what appears overhead may be simply a rectangular or circular light emission area, rather than a bulky light fixture structure.

Such canopy-mounted light fixtures of the prior art often have certain shortcomings and disadvantages related to servicing. When such light fixtures are positioned primarily above the canopy sheet, servicing may be particularly difficult and time-consuming. This invention addresses such shortcomings and disadvantages.

It would be desirable and economically advantageous to be able to easily service and replace functioning elements of the overhead light fixture, such as replacing or servicing LED drivers, while retaining the fixture in place above the canopy sheet. Some efforts have been directed toward this goal, but there remains a need for a low-cost and very easily serviceable overhead light fixture of this type, including overhead LED light fixtures.

SUMMARY OF THE INVENTION

This invention is an overhead LED light fixture which includes: a base member having a top and a bottom, having an outward frame, and defining a pass-through opening; a sleeve secured at the top of the base member for alignment with the pass-through opening; and a driver-tray assembly having a bottom member engageable with the base member at the pass-through opening, a driver-support structure extending upwardly therefrom, and at least one driver secured to the support structure, the driver-tray assembly being slideably received within the sleeve. The driver-tray assembly is removable from below the frame to facilitate servicing.

In certain embodiments, the overhead LED light fixture is for installation in an overhead canopy having a canopy sheet with a fixture-receiving opening. In such situations, the base member includes a flange for engagement with the canopy sheet. The driver-tray assembly is removable from below the canopy to facilitate servicing, upgrading or replacing.

The LED light fixture includes at least one light bar secured with respect to the base member and a heat sink secured above and in contact with the light bar(s). A junction box is secured atop the sleeve and has downwardly-facing plug connectors which mate with upwardly-facing plug connectors on the support structure. In this embodiment as well the driver-tray assembly is removable from below the canopy to facilitate servicing, upgrading or replacing.

In some embodiments, the LED driver tray includes two drivers secured to the support structure and the vertical sleeve is a cover enclosing the driver(s). In certain embodiments the bottom member of the driver tray assembly includes a motion sensor with a lens exposed at the pass-through opening of the base member.

Another aspect of this invention is a light fixture including,: (1) a base member having a first side from which fixture fiat is emitted and an opposite second side, the base member including an outward frame and defining a pass-through opening; (2) a sleeve secured at the second side of the base member for alignment with the pass-through opening; and (3) a driver-tray assembly having a base-engageable member at the pass-through opening, a driver-support structure extending therefrom in a direction away from the base member, and at least one driver secured to the support structure, the driver-tray assembly being slideably inserted within the sleeve. This structure is such that the driver-tray assembly is removable by withdrawal through the pass-through opening to facilitate servicing.

Another aspect of this invention is a method for servicing an overhead LED light fixture of the type described. The method will be described with particular reference to the canopy-mounted light fixture described above, in which the described structure is provided.

In the method of this invention, the bottom member of the driver-tray assembly is disengaged from the base member and the driver-tray assembly is slideably withdrawn (downwardly) from the vertical sleeve. In starting such withdrawal, the upwardly-facing plug connectors are disconnected from the downwardly-facing plug connectors by downward pulling of the structure being removed. When the driver-tray assembly has been removed, the drivers are serviced or replaced, or other service is performed. Servicing the drivers may include upgrading the drivers. Thereafter, the driver-tray assembly is slideably reinserted into the vertical sleeve until the upwardly-facing plug connectors are reconnected with the downwardly-facing plug connectors.

While the lighting fixture of this invention has been described with particular reference to embodiments which are overhead or canopy light fixtures, it should be recognized that in some cases the light fixtures may be mounted or deployed in other locations, orientations and positions.

In descriptions of this invention, including in the claims below, the terms "comprising," "including" and "having" (each in their various forms) and the term "with" are each to be understood as opened-ended, rather than limiting, terms.

DETAILED DESCRIPTION OF EMBODIMENTS

Figure 1:
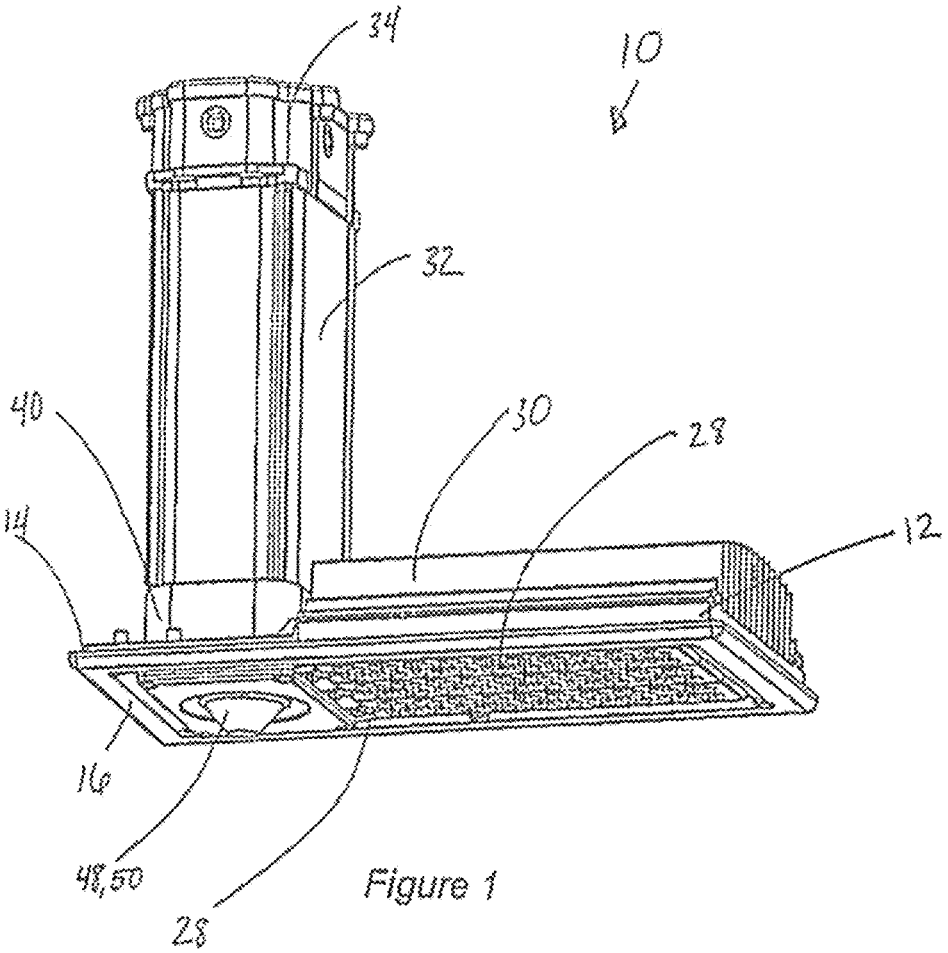
FIG. 1 is a perspective view of an embodiment of the inventive LED light fixture.
Figure 2:
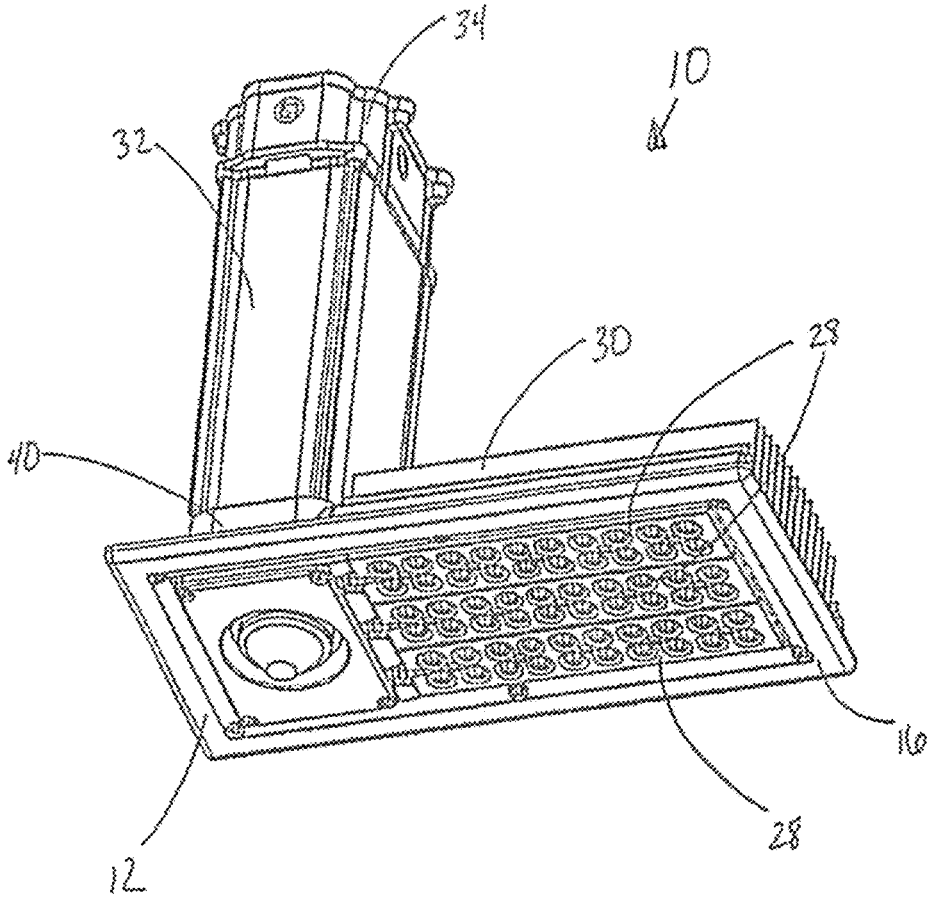
FIG. 2 is a bottom perspective view of the overhead LED light fixture of FIG. 1.
Figure 3:
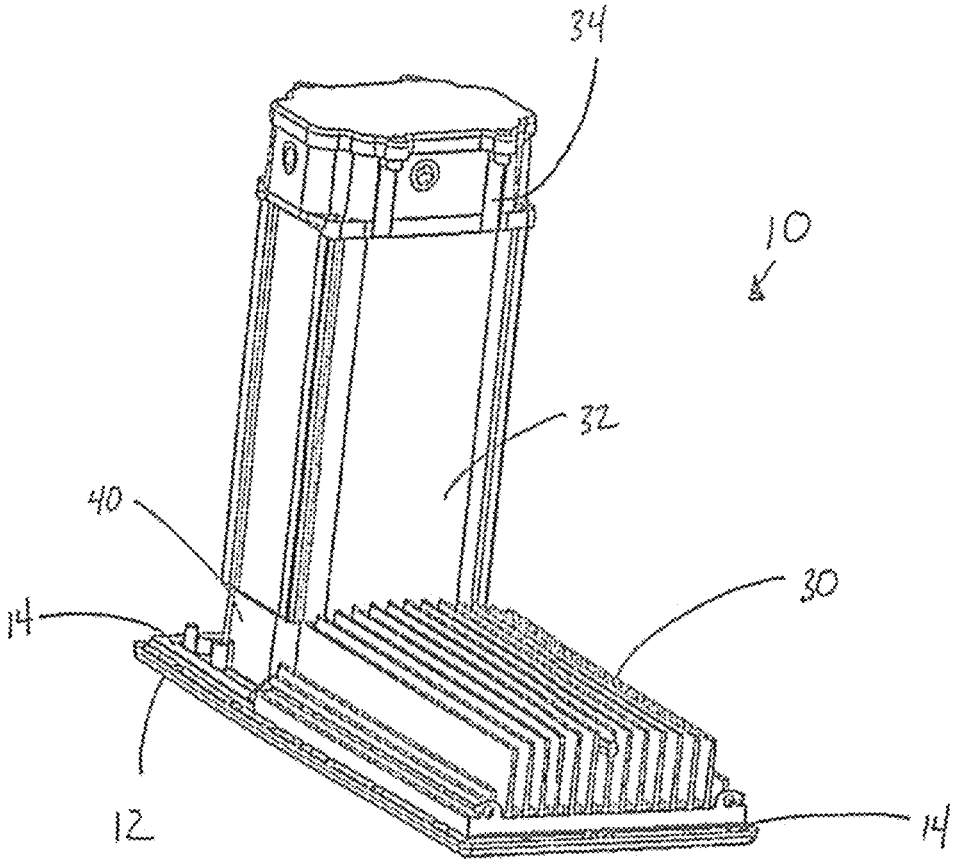
FIG. 3 is a top perspective view of the LED light fixture of FIG. 1.
Figure 10:
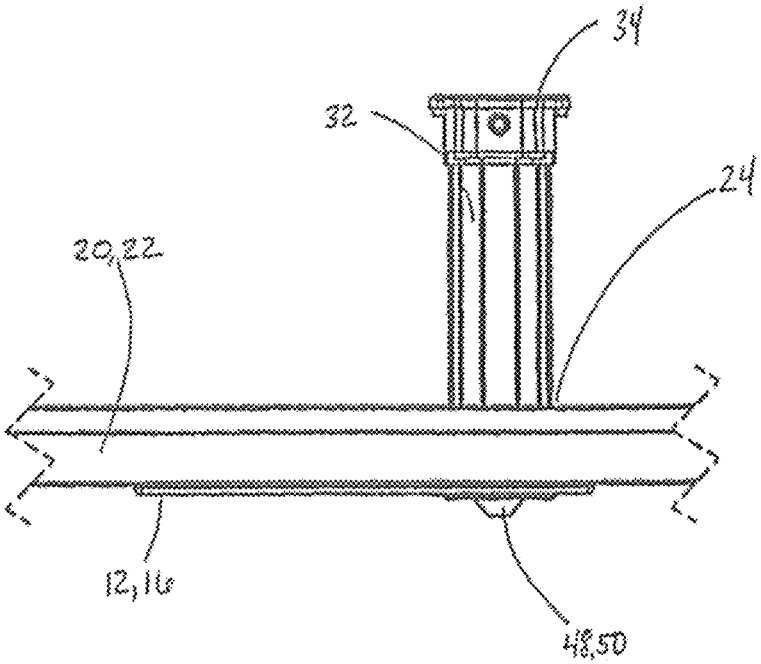
FIG. 10 is a side view of the LED light fixture of FIG. 1, illustrating the fixture installed on an overhead canopy.

FIGS. 1-3 are perspective views of an embodiment of the inventive LED light fixture 10. Fixture 10 is installed in an overhead canopy 22 as seen in FIG. 10. Canopy 22 typically includes a canopy sheet 20 with a fixture-receiving opening 24 therethrough. Fixture 10 includes a base member 12 having a top 14, a bottom 16, and a flange 18 for engagement with canopy sheet 20 as seen in FIGS. 1-3 and 10. Base member 12 defines a pass-through opening 26.

Figure 4:
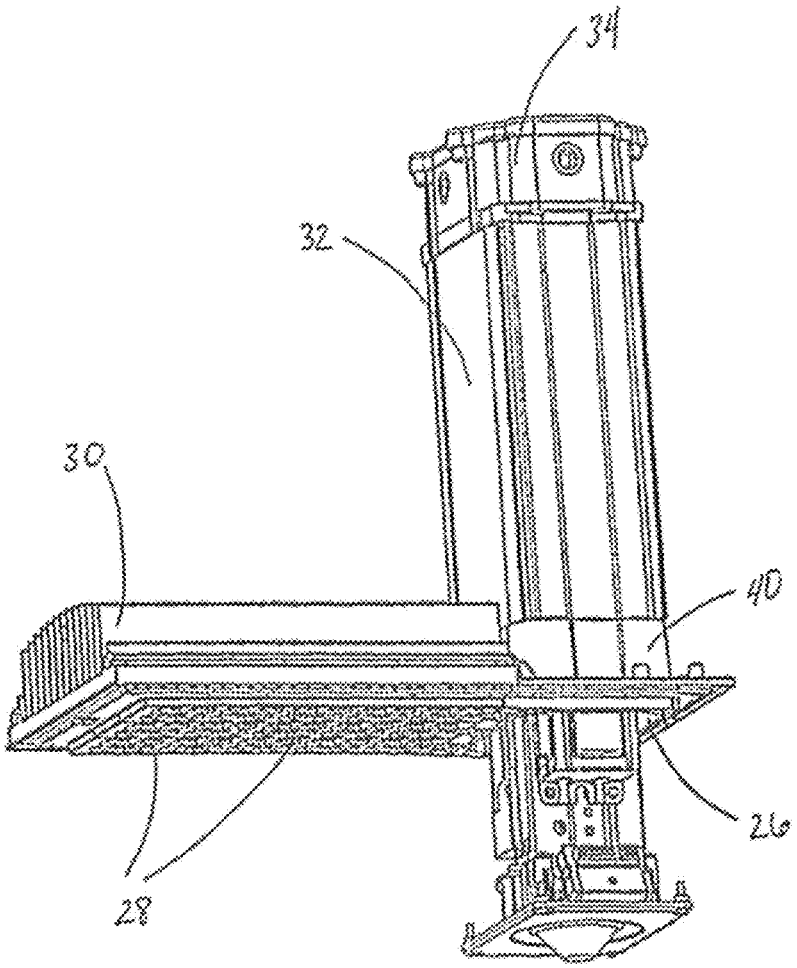
FIG. 4 is a perspective view of the LED light fixture of FIG. 1 shown with the driver-tray assembly partially removed from the vertical sleeve.

A vertical sleeve 32 is secured at top 14 of base member 12 for alignment with pass-through opening 26 as seen in FIGS. 1-5. Vertical sleeve 32 is also secured to bottom member 40 as seen in FIG. 1. Driver-tray assembly 38 has a bottom casting 51, bottom member 40 is part of base member 12 and is engageable with bottom casting 51. Driver-tray assembly 38 includes a vertical driver-support structure 42 extends upwardly therefrom, at least one driver 44 is secured to support structure 42 and support structure 42 has upwardly-facing plug connectors 46. Driver-tray assembly 38 is slideably received within vertical sleeve 32 as seen in FIGS. 1, 2 and 4. Driver-tray assembly 38 is removable from below canopy 22 to facilitate servicing, upgrading or replacing of components.

Base member 12 includes at least one light bar 28 secured with respect to base member 12 as seen in FIGS. 1 and 2. Base member also includes a heat sink 30 secured above and in contact with the light bar(s) 28 as seen in FIG. 3. A junction box 34 is secured atop sleeve 32 as shown in FIGS. 1-3, junction box has downwardly-facing plug connectors 36 as seen best in FIG. 9. Downwardly-facing plug connectors 36 mate with upwardly-facing plug connectors 46.

Figure 5:
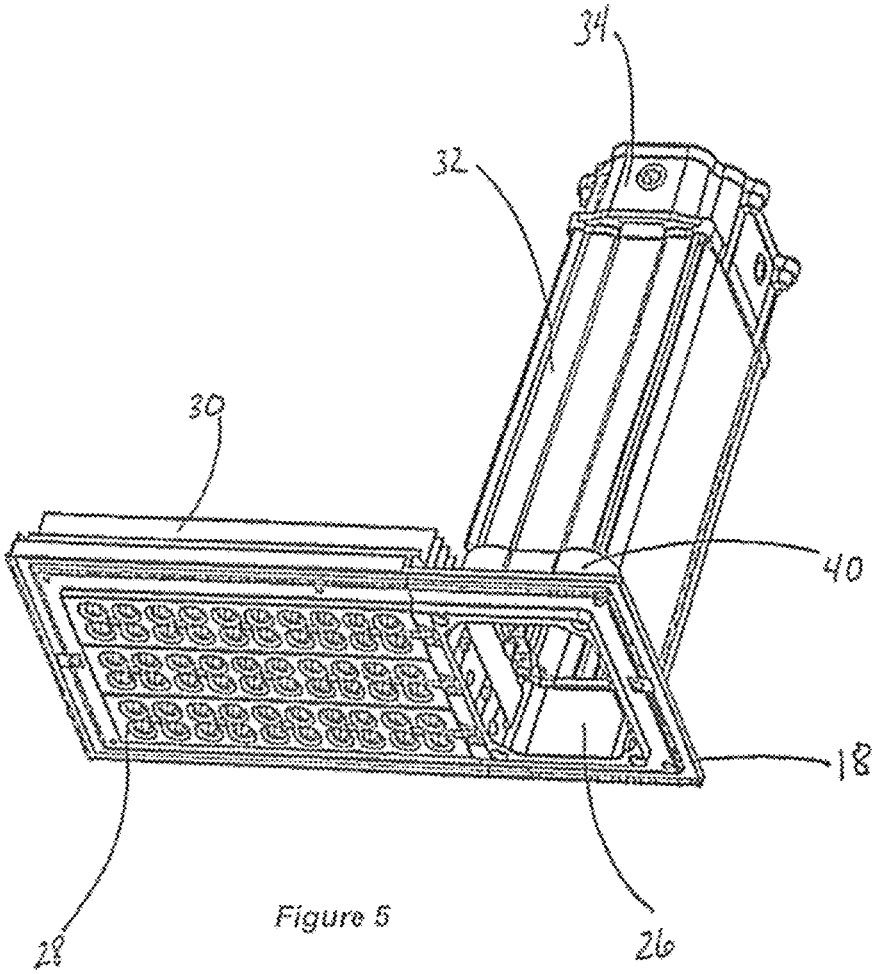
FIG. 5 is a perspective view of the LED light fixture of FIG. 1 shown with the driver-tray assembly having been removed.

FIG. 4 illustrates that driver-tray assembly 38 can be removed from vertical sleeve 32. Driver-tray assembly is able to be completely slid out from contact with vertical sleeve 32 to allow for access to the drivers 44. Driver-tray assembly 38 is held in contact with vertical sleeve 32 through the use of fasteners. Note that this embodiment shows four holes and fasteners but some embodiments of this inventive. fixture may include fewer than four holes and fasteners. FIG. 5 shows driver-tray assembly 38 completely removed from vertical sleeve 32.

Figure 6:
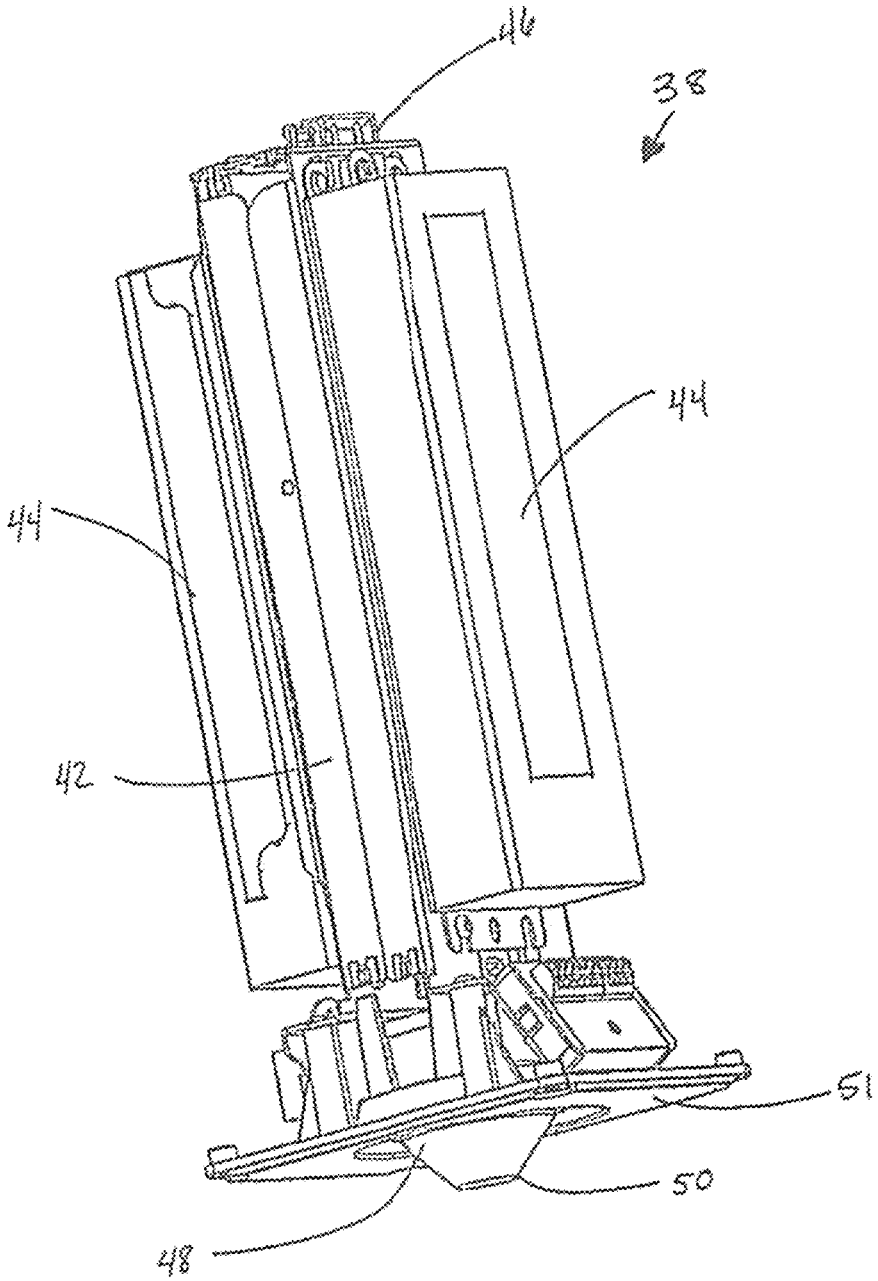
FIG. 6 is a perspective view of the driver-tray assembly with drivers.

FIG. 6 shows driver-tray assembly 38 removed from vertical sleeve 32. Driver-tray assembly 38, as shown in FIG. 6, includes two drivers 44 secured to driver-support structure 42. Driver-tray assembly 38 can also include only one driver 44 or more drivers 44 depending on the needed configuration. Vertical sleeve 32 is a cover which encloses the drivers 44.

As seen in FIG. 6, one embodiment of bottom casting 51 of driver-tray assembly 38 includes a motion sensor 48 with a lens 50 exposed at the pass-through opening 26 of base member 12. Other embodiments of driver-tray assembly 38 do not include a motion sensor 48 with lens 50.

Bottom member 40 is a casting that is part of base member 12 and provides pass-through opening 26. In some embodiments, bottom member 40 is secured to heat sink 30 on one side and can also include a flange 18 for interaction between base member 12 and canopy 22. Bottom member 40 can also include a gasket (not shown) for securement of vertical sleeve 32. Driver tray assembly 38 includes bottom casting 51 as shown in FIG. 6 that provides support and securement means for support. structure 42. Bottom casting 51 also engages base member 12 at pass-through opening 26 and is secured to bottom member 40 to complete the assembly.

Figure 7:
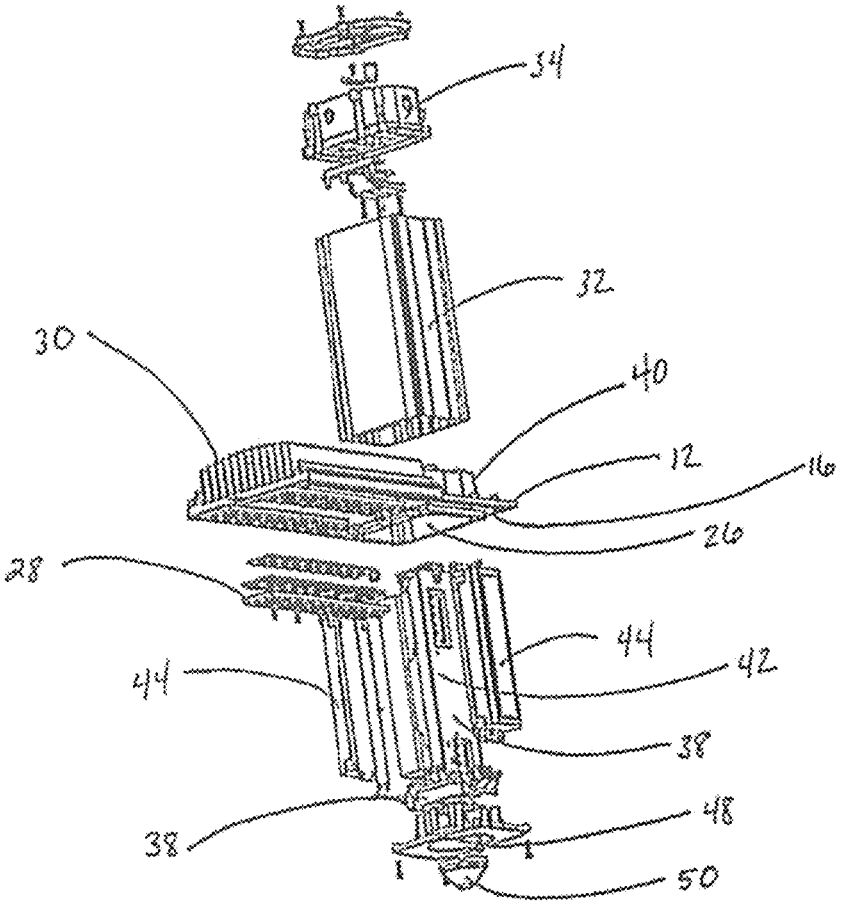
FIG. 7 is an exploded view of the LED light fixture of FIG. 1.

FIG. 7 is an exploded view of fixture 10 illustrating all of the components of fixture 10 including the relationship between base member 12, vertical sleeve 32, junction box 34 and driver-tray assembly 38. FIG. 7 also illustrates that junction box 34 is held in contact with vertical sleeve 32 by any type of suitable fastening technique. For example, screws and corresponding mounting holes may be used.

Figure 8:
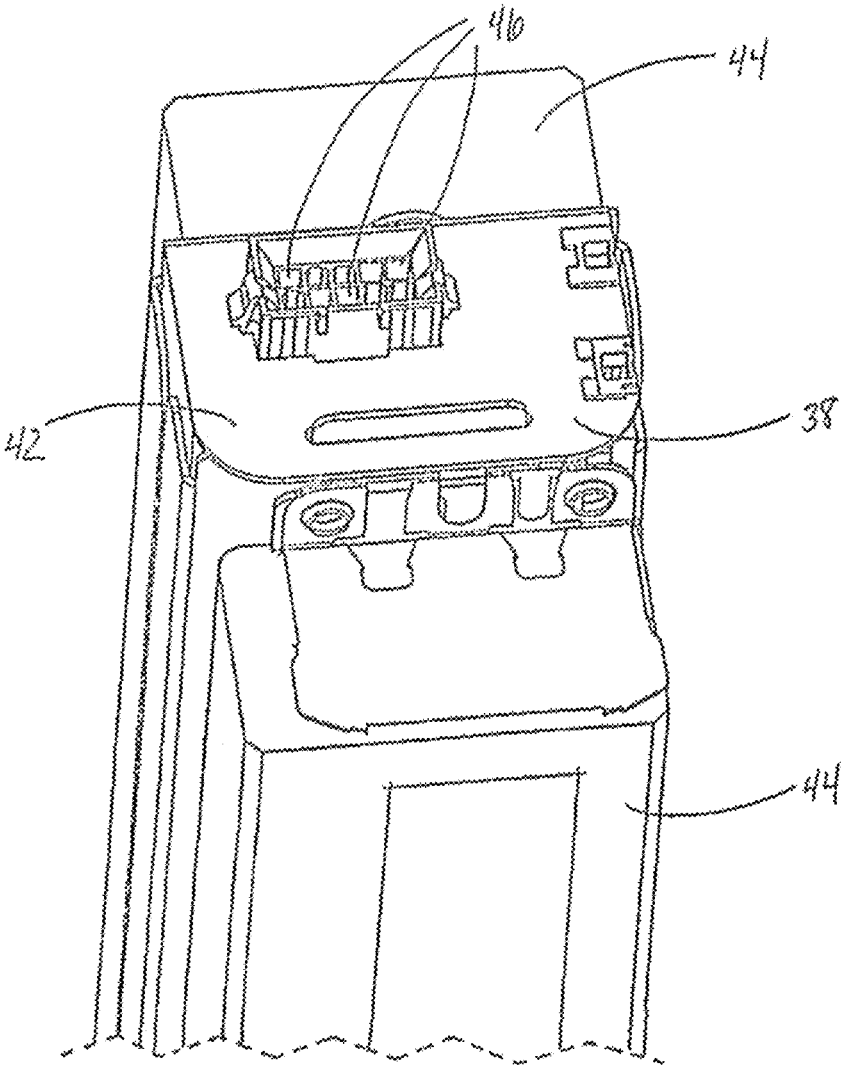
FIG. 8 is a top perspective view of the LED light fixture of FIG. 1, showing the upwardly-facing plug connectors.
Figure 9:
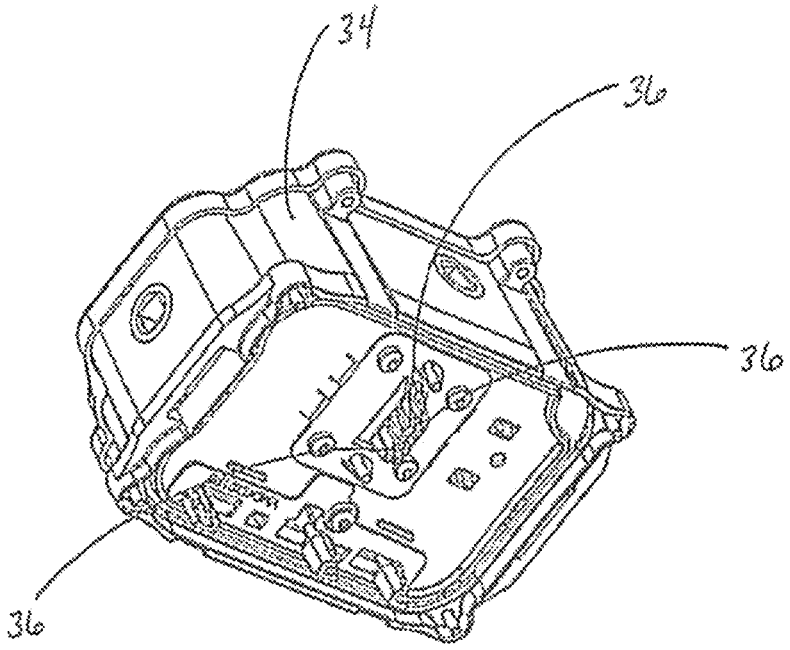
FIG. 9 is a perspective view of the junction box showing the downwardly-facing plug connectors.

FIG. 8 illustrates that vertical driver-support structure 42 holds at least one driver 44 (two drivers 44 are shown in FIG. 8). Support structure 42 has upwardly-facing plug connectors 46 (FIG. 8) which mate with the downwardly-facing plug connectors 36 on a lower surface of junction box 34 (FIG. 9). Plug connectors are just one type of connection device which may be used to connect support structure 42 with junction box 34. Other connection devices may also be used which would be suitable for this application.

As seen in FIGS. 1-5, there are many configurations for light bar 28. Fixture 10 can include one light bar 28 or many light bars 28 depending on the specific location and need. The size and shape of heat sink 30 will vary depending on the number of light bars 28 in a particular configuration. Light bar(s) 28 are held in place by any type of suitable fastening technique. For example, screws and corresponding mounting holes. Motion sensor 48 and corresponding lens 50 are shown in the drawings as just one or many possible configurations. Fixture 10 can be formed out of die cast and extruded aluminum, however, fixture 10 can be made of any other suitable material. In some embodiments fixture 10 can be beneficially used in canopy lighting as described above, however, other applications are also possible.

In a method of use for servicing or replacing driver(s) 44, fixture 10 is provided which includes: base member 12 having a top 14, a bottom 16, and a pass-through opening 26 as well as a vertical sleeve 32 in contact with top 14 of base member 12 in alignment with pass-through opening 26. Vertical sleeve 32 is also secured to bottom member 40 as seen in FIG. 1. Junction box 34 is also provided and secured atop sleeve 32 and has downwardly-facing plug connectors 36. Driver-tray assembly 38 is also provided and has bottom casting 51 engageable with base member 12, a vertical driver-support structure 42 extending upwardly therefrom, at least one driver 44 secured to support structure 42 and upwardly-facing plug connectors 46 mating with downwardly-facing plug connectors 36, driver-tray assembly 38 is slideably received within vertical sleeve 32.

Next, bottom casting 51 (as seen in FIG. 6) of driver-tray assembly 38 is disengaged from base member 12. Driver-tray assembly 38 is then slideably withdrawn from vertical sleeve 32 and, in starting such withdrawal, upwardly-facing plug connectors 46 are disconnected from downwardly-facing plug connectors 36. Finally, driver(s) 44 are serviced, repaired or upgraded and driver-tray assembly 38 is then slideably reinserted into vertical sleeve 32 until upwardly-facing plug connectors 46 are reconnected with downwardly-facing plug connectors 36.

While the principles of this invention have been described in connection with specific embodiments, it should be understood clearly that these descriptions are made only by way of example and are not intended to limit the scope of the invention.

The invention claimed is:

1. An overhead LED light fixture comprising:

a base member having a top and a bottom, the base member defining a light-bar support region and a pass-through opening laterally offset therefrom, and including an outward frame surrounding the light-bar support region and pass-through opening;

a sleeve secured at the top of the base member for alignment with the pass-through opening; and a driver-tray assembly having a bottom member engageable with the base member at the pass-through opening, a vertical driver-support structure extending upwardly therefrom, and at least one driver secured to the support structure, the driver-tray assembly being slideably received within the sleeve, whereby the driver-tray assembly is removable from below the frame to facilitate servicing.

2. The fixture assembly of claim 1 wherein the LED driver-tray assembly is vertical and includes two vertically-secured drivers on the support structure.

3. The fixture assembly of claim 1 wherein the sleeve is vertical and serves as a cover enclosing the driver(s).

4. The fixture assembly of claim 1 wherein the bottom member of the driver-tray assembly includes a motion sensor with a lens exposed at the pass-through opening of the base member.

5. An LED light fixture for installation with respect to an overhead canopy having a canopy sheet with a fixture-receiving opening therethrough, the fixture comprising:

a base member having a top and a bottom, and a flange for engagement with the canopy sheet, the base member defining a light-bar support region and a pass-through opening laterally offset therefrom, and including an outward frame surrounding the light-bar support region and pass-through opening;

a vertical sleeve secured at the top of the base member for alignment with the pass-through opening; and a driver-tray assembly having a bottom member engageable with the base member at the pass-through opening, a vertical driver-support structure extending upwardly therefrom, and at least one driver secured to the support structure, the driver-tray assembly being slideably received within the vertical sleeve, whereby the driver-tray assembly is removable from below the canopy to facilitate servicing.

6. The fixture assembly of claim 5 wherein the LED driver-tray assembly includes two vertically-secured drivers on the support structure.

7. The fixture assembly of claim 5 wherein the vertical sleeve is a cover enclosing the driver(s).

8. The fixture assembly of claim 5 wherein the bottom member of the driver-tray assembly includes a motion sensor with a lens exposed at the pass-through opening of the base member.

9. An LED light fixture for installation with respect to an overhead canopy having a canopy sheet with a fixture-receiving opening therethrough, the fixture comprising:

a base member having a top and a bottom, and a flange for engagement with the canopy sheet, the base member defining a light-bar support region and a pass-through opening laterally offset therefrom, and including an outward frame surrounding the light-bar support region and pass-through opening;

at least one light bar secured with respect to the base member;

a heat sink secured above and in contact with the light bar(s);

a vertical sleeve secured at the top of the base member for alignment with the pass-through opening;

a junction box secured atop the sleeve and having downwardly-facing plug connectors;

a driver-tray assembly having a bottom member engageable with the base member at the pass-through opening, a vertical driver-support structure extending upwardly therefrom, at least one driver secured to the support structure, and upwardly-facing plug connectors mating with the downwardly-facing plug connectors, the driver-tray assembly being slideably received within the vertical sleeve, whereby the driver-tray assembly is removable from below the canopy to facilitate servicing.

10. The fixture assembly of claim 9 wherein the LED driver-tray assembly includes two vertically-secured drivers on the support structure.

11. The fixture assembly of claim 9 wherein the vertical sleeve is a cover enclosing the driver(s).

12. The fixture assembly of claim 9 wherein the bottom member of the driver-tray assembly includes a motion sensor with a lens exposed at the pass-through opening of the base member.

13. A method for servicing or replacing driver(s) of an LED light fixture installed with respect to an overhead canopy, the canopy having a canopy sheet and a fixture-receiving opening therethrough, the method comprising the steps of:

providing a fixture including: a base member having a top and a bottom, the base member defining a light-bar support region and a pass-through opening laterally offset therefrom, and including an outward frame surrounding the light-bar support region and pass-through opening; a vertical sleeve secured to the top of the base member in alignment with the pass-through opening; a junction box secured atop the sleeve and having downwardly-facing plug connectors; and a driver-tray assembly having a bottom member engageable with the base member, a vertical driver-support structure extending upwardly therefrom, at least one driver secured to the support structure, and upwardly-facing plug connectors mating with the downwardly-facing plug connectors, the driver tray assembly being slideably received within the vertical sleeve;

disengaging the bottom member of the driver-tray assembly from the base member;

slideably withdrawing the driver-tray assembly from the vertical sleeve and, in starting such withdrawal, disconnecting the upwardly-facing plug connectors from the downwardly-facing plug connectors;

servicing or replacing the driver(s); and slideably reinserting the driver-tray assembly into the vertical sleeve until the upwardly-facing plug connectors are reconnected with the downwardly-facing plug connectors.

14. An LED light fixture comprising:

a base member having a first side from which fixture light is emitted and an opposite second side, the base member defining a light-bar support region and a pass-through opening laterally offset therefrom, and including an outward frame surrounding the light-bar support region and pass-through opening;

a sleeve secured at the second side of the base member for alignment with the pass-through opening; and a driver-tray assembly having a base-engageable member at the pass-through opening, a driver-support structure extending therefrom in a direction away from the base member, and at least one driver secured to the support structure, the driver-tray assembly being slideably inserted within the sleeve, whereby the driver-tray assembly is removable by withdrawal through the pass-through opening to facilitate servicing.

15. The fixture assembly of claim 14 wherein the LED driver-tray assembly is vertical and includes two vertically-secured drivers on the support structure.

16. The fixture assembly of claim 14 wherein the sleeve is vertical and serves as a cover enclosing the driver(s).

17. The fixture assembly of claim 14 wherein the base-engageable member including a motion sensor with a lens exposed at the pass-through opening.

* * * * *